US008298074B1

(12) United States Patent
Gibase et al.

(10) Patent No.: US 8,298,074 B1
(45) Date of Patent: Oct. 30, 2012

(54) SYSTEMS AND METHODS FOR REWARDING PLAYERS OF SLOT MACHINES ON AN INDIVIDUAL BASIS

(75) Inventors: Chris Gibase, Henderson, NV (US); Dennis Frey, Las Vegas, NV (US)

(73) Assignee: Boyd Gaming Corporation, Las Vegas, NV (US)

( * ) Notice: Subject to any disclaimer, the term of this patent is extended or adjusted under 35 U.S.C. 154(b) by 1344 days.

(21) Appl. No.: 11/738,293

(22) Filed: Apr. 20, 2007

Related U.S. Application Data

(60) Provisional application No. 60/796,062, filed on Apr. 28, 2006.

(51) Int. Cl.
*A63F 9/24* (2006.01)
*G06Q 30/00* (2006.01)

(52) U.S. Cl. ..... 463/25; 463/42; 705/14.12; 705/14.21; 705/14.27

(58) Field of Classification Search ..... 463/21, 463/25; 705/14.11, 14.14, 14.25, 14.27, 705/14.32, 14.37, 14.39
See application file for complete search history.

(56) References Cited

U.S. PATENT DOCUMENTS 5,752,882 A 5/1998 Acres et al.
6,302,793 B1 10/2001 Fertitta, III et al.
6,319,125 B1 11/2001 Acres
6,371,852 B1 4/2002 Acres
6,416,409 B1 7/2002 Jordan
6,565,434 B1 5/2003 Acres
6,575,832 B1 6/2003 Manfredi et al.
6,712,695 B2 3/2004 Mothwurf et al.
6,712,697 B2 3/2004 Acres
6,878,063 B2 4/2005 Manfredi et al.
6,910,964 B2 6/2005 Acres
6,966,834 B1 11/2005 Johnson
7,749,081 B1 * 7/2010 Acres ..... 463/31
2002/0142846 A1 * 10/2002 Paulsen ..... 463/43
2003/0078101 A1 4/2003 Schneider et al.
2003/0100360 A1 5/2003 Manfredi et al.
2003/0176219 A1 9/2003 Manfredi et al.
2004/0142742 A1 7/2004 Schneider et al.
2004/0254010 A1 * 12/2004 Fine ..... 463/25
2005/0054430 A1 3/2005 Pitman et al.
2005/0119052 A1 6/2005 Russell et al.
2005/0143166 A1 6/2005 Walker et al.
2006/0080175 A1 4/2006 Rowe et al.

* cited by examiner

*Primary Examiner* — Peter DungBa Vo
*Assistant Examiner* — Damon Pierce
(74) *Attorney, Agent, or Firm* — Austin Rapp & Hardman

(57) ABSTRACT

A method for providing a personalized rewards program for slot machine players may involve monitoring activity of slot machine players on one or more slot machines during a reward event. The method may also involve determining reward credits to be provided to the slot machine players. The reward credits that are provided to a player may depend on that player's level of play during the reward event. The method may also involve distributing the reward credits to the slot machine players.

17 Claims, 10 Drawing Sheets

SYSTEMS AND METHODS FOR REWARDING PLAYERS OF SLOT MACHINES ON AN INDIVIDUAL BASIS

RELATED APPLICATIONS

This application is related to and claims priority from U.S. Patent Application Ser. No. 60/796,062 filed Apr. 28, 2006, for "Systems and Methods for Rewarding Players of Slot Machines on an Individual Basis," with inventors Chris Gibase and Dennis J. Frey, which is incorporated herein by reference.

TECHNICAL FIELD

The present invention relates generally to gaming and gaming-related technology. More specifically, the present invention relates to systems and methods for rewarding players of slot machines on an individual basis.

BACKGROUND

Gaming (sometimes referred to as gambling) generally involves placing a wager on various possible random outcomes or combinations of outcomes in hopes of winning a reward (typically money). A popular recreational activity, gaming is enjoyed by many people around the world.

A casino is a facility that accommodates gaming activities. Casinos are typically combined with hotels, and may offer other forms of entertainment in addition to gaming. For example, casinos may include restaurants, live entertainment events (e.g., boxing, concerts, etc.), retail shopping, and so forth.

Slot machines are one of the most popular attractions in casinos. One type of slot machine is a mechanical device that includes a number of spinning reels and a payline. Another type of slot machine is a computing device that includes a display screen. On this type of slot machine, the "reels" and the "payline" may be images that are displayed on the display screen. Typically, the goal when playing a slot machine is to spin the reels (either the mechanical reels or the images of reels on the video display) so that the symbols on all of the reels line up on the payline (either a physical payline or an image of a payline on a video display) in a winning combination. When a player achieves a winning combination in this manner, the player may win a payout. The amount of the payout may be determined by a payout table, which may be posted on the front of the slot machine or contained on the display screen.

A significant percentage of a casino's revenue is generated by slot machine players. As a result, casinos compete quite aggressively for slot machine players. Casinos are constantly searching for new, unique, and interesting ways to attract slot machine players. Some casinos offer programs that provide rewards for players of slot machines.

With typical reward programs, promotional points are awarded to a player based on the player's activity at the slot machines within a particular casino or within affiliated casinos. Promotional points may be awarded based upon amounts wagered, games played, or numerous other money transactions between a player and a casino. The promotional points may be redeemable for gifts, meals, cash and the like.

Some slot machine players spend quite a bit of money while playing slot machines, while others may not spend as much money while playing. In addition, some slot machine players may play quite frequently, while other slot machine players may play on an infrequent basis. In some cases a relatively small percentage of slot machine players may generate most of the slot machine-related revenue for a casino. The present disclosure relates to improved systems and methods for providing rewards for players of slot machines.

DETAILED DESCRIPTION

Figure 1:
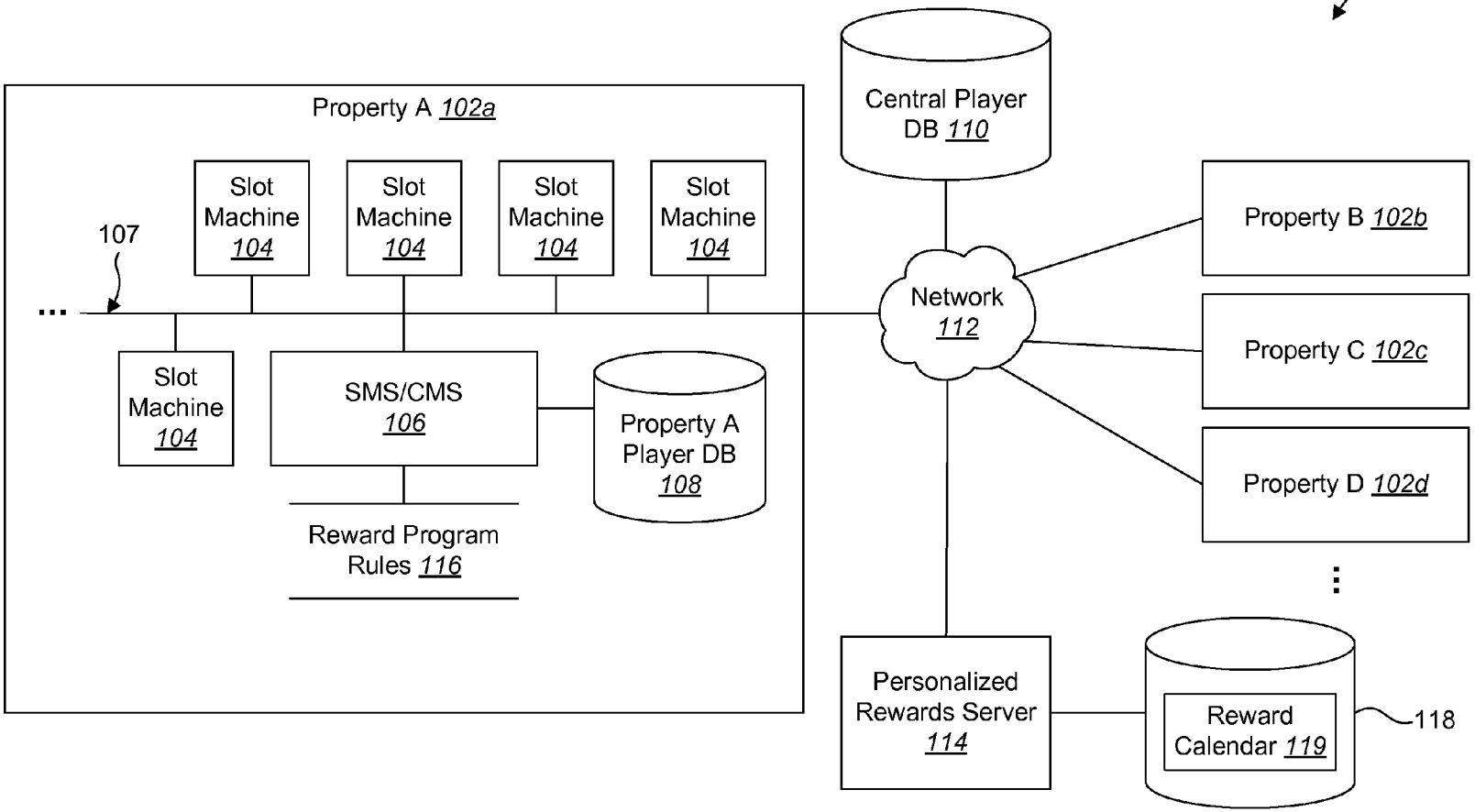
FIG. 1 illustrates an exemplary system in which embodiments may be practiced.

A method for providing a personalized rewards program for slot machine players is disclosed. The method may involve monitoring activity of slot machine players on one or more slot machines during a reward event. The method may also involve determining reward credits to be provided to the slot machine players. The reward credits that are provided to a player may depend on that player's level of play during the reward event. The method may also involve distributing the reward credits to the slot machine players.

The method may also involve providing an estimated reward calendar. The estimated reward calendar may indicate a total amount of money to be distributed to the slot machine players as part of the reward event.

The method may also involve providing share awards to a qualifying slot machine player during the reward event based on the qualifying slot machine player's level of play during the reward event. In this situation, determining reward credits may involve multiplying the share awards that were provided to the qualifying player during the reward event by an individual share award value for the reward event. The individual share award value may depend on at least one of: a promotion code, a date, and a property.

The qualifying player may receive one share award each time that the qualifying player wagers a threshold amount on the one or more slot machines during the reward event. The threshold amount for a slot machine may depend on at least one of: a property where the slot machine is located, a zone in the property in which the slot machine is located, a coin denomination that is used by the slot machine, a game type that is being played on the slot machine, and combinations thereof. When a subsequent reward event begins, the slot machine players' share awards for the subsequent reward event may be set to zero.

A notification message may be displayed on a display screen of a slot machine in response to a current player of the slot machine qualifying for an initial share award. Similarly, a notification message may be displayed on a display screen of a slot machine each time that a current player of the slot machine qualifies for an additional share award.

The method may also involve detecting when multiple reward cards associated with a same player account are used to play on multiple slot machines simultaneously. In this situation, any share awards that are provided as a result of playing on the multiple slot machines simultaneously may be aggregated.

The method may also involve notifying the slot machine players about the reward credits. The slot machine players may be notified about the reward credits via e-mail. The method may also involve allowing the slot machine players who have received the reward credits to use the reward credits to play on the one or more slot machines. The method may also involve deducting at least some of the reward credits from the slot machine players' accounts based on one or more defined adjustment rules.

The reward credits that are provided to a qualifying player may include a combination of non-cashable credits, cashable credits, and hand-paid funds. For example, the reward credits may include non-cashable credits up to a first reward threshold, cashable credits between the first reward threshold and a second reward threshold, and hand-paid funds beyond the second reward threshold.

The method may also involve displaying reward program information on a display screen of a slot machine. The reward program information may be displayed via an interface that is selected from the group consisting of a slot monitoring system interface, an iCMS interface, an Iview interface, and an NT interface.

The method may also involve providing access to reward program information via one or more kiosks. The method may also involve providing access to reward program information via an e-commerce interface.

A method for providing a personalized rewards program for slot machine players is also disclosed. The method may involve monitoring activity of slot machine players on slot machines at one or more participating properties during a reward event. The method may also involve adjusting hold percentages of the slot machines for the slot machine players based on the slot machine players' level of play during the reward event. The hold percentages may be adjusted without making adjustments to the slot machines themselves.

Several exemplary embodiments are now described with reference to the Figures. This detailed description of several exemplary embodiments, as illustrated in the Figures, is not intended to limit the scope of the claims.

The word "exemplary" is used exclusively herein to mean "serving as an example, instance or illustration." Any embodiment described as "exemplary" is not necessarily to be construed as preferred or advantageous over other embodiments.

As used herein, the terms "an embodiment," "embodiment," "embodiments," "the embodiment," "the embodiments," "one or more embodiments," "some embodiments," "certain embodiments," "one embodiment," "another embodiment" and the like mean "one or more (but not necessarily all) embodiments," unless expressly specified otherwise.

The term "determining" (and grammatical variants thereof) is used in an extremely broad sense. The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

FIG. 1 illustrates an exemplary system 100 in which embodiments may be practiced. The system 100 may be implemented across a number of different properties 102, such as property A 102*a*, property B 102*b*, property C 102*c*, and property D 102*d*. As used herein, the term "property" may refer to any facility that includes slot machines and that allows at least some patrons to play on the slot machines. For example, the term "property" may refer to a casino. Alternatively, the term "property" may refer to other types of facilities, such as restaurants, grocery stores, airports, etc. Each of the properties 102 shown in FIG. 1 may be owned, managed, or under the control of the same gaming organization.

Within property A 102*a*, a number of different slot machines 104 may be provided. As discussed above, a slot machine 104 typically includes a number of spinning reels and a payline. Typically, the goal when playing a slot machine 104 is to spin the reels (either the mechanical reels or the images of reels on the video display) so that the symbols on all of the reels line up on the payline (either a physical payline or an image of a payline on a video display) in a winning combination. When a player achieves a winning combination in this manner, the player may win a payout.

A slot monitoring system (SMS) and/or a casino management system (CMS) may be provided for property A 102*a*. The slot monitoring system and casino management system may be referred to collectively as an SMS/CMS system 106. Thus, a reference to the SMS/CMS system 106 may refer to a slot monitoring system, a casino management system, or both a slot monitoring system and a casino management system. The SMS/CMS system 106 may be implemented using a single computer system, or the SMS/CMS system 106 may be implemented across multiple computer systems.

The slot machines 104 within property A 102*a* may be in electronic communication with the SMS/CMS system 106 via a local area network (LAN) 107. The SMS/CMS system 106 may be used to implement reward programs for players of the slot machines 104. As part of implementing reward programs, the SMS/CMS system 106 may monitor and track player activity on the slot machines 104. The SMS/CMS system 106 may also store information about players' activity on the slot machines 104 in a player database 108 that is maintained for property A 102*a*. Although not explicitly shown in FIG. 1, property B 102*b*, property C 102*c*, and property D 102*d* may be configured similarly to property A 102*a*.

A central player database 110 may also be provided. The central player database 110 may be in electronic communication with the SMS/CMS systems 106 at the various properties 102 via a network 112, which may be a wide area network. From time to time, the information that is stored in the player database 108 at the various properties 102 may be uploaded to the central player database 110.

As discussed above, embodiments disclosed herein relate generally to systems and methods for providing rewards for players of slot machines 104. In accordance with an embodiment, a personalized rewards server 114 may be provided. As shown in FIG. 1, the personalized rewards server 114 may be in electronic communication with the slot machines 104 and/or the SMS/CMS systems 106 at the various properties 102 via the network 112.

The personalized rewards server 114 may be used to provide personalized rewards to slot machine players. As used herein, the term "personalized" rewards may mean that slot machine players who play more frequently and/or spend more money while playing are able to earn more rewards than slot machine players who do not play as often and/or who do not spend as much money. The personalized rewards server 114 and the SMS/CMS systems 106 at each of the properties 102 may work together to implement reward programs that provide personalized rewards to slot machine players. Various rules 116 for the events may be defined. The SMS/CMS systems 106 at the various properties 102 may access these rules 116 to implement various aspects of the reward programs.

A brief overview of the operation of the personalized rewards server 114 and the SMS/CMS system 106 systems at participating properties 102 will now be provided. In accordance with an embodiment, players may be allowed to participate in pre-determined "reward events." During a reward event, the SMS/CMS system 106 at a particular property 102 monitors player activity on the slot machines 104 at that property 102, and provides "share awards" to players based on their level of play on the slot machines 104. In general terms, the more money that a particular player spends playing on slot machines 104, the greater the number of share awards that may be awarded to the player. (This will be explained in greater detail below.) The player database 108 at a particular property may be used to store information about the share awards that have been earned by players at the property 102.

The SMS/CMS system 106 may notify the personalized rewards server 114 about the total number of share awards that have been awarded to all players in the aggregate. The personalized rewards server 114 may store this information in a database 118 that will be referred to as a personalized rewards server database 118.

At the end of the reward event, the personalized rewards server 114 may determine the value of an individual share award, and may provide this information to the SMS/CMS systems 106 at each of the participating properties 102. An estimated reward calendar 119 may be utilized to determine the value of an individual share award. The estimated reward calendar 119 may indicate the total amount of money that will be distributed to participating slot machine players in connection with the reward event. By dividing the total amount of money to be distributed in connection with the reward event by the total number of share awards that have been distributed during the reward event, the value of an individual share award may be determined.

Once the SMS/CMS systems 106 at the participating properties 102 are notified concerning the value of an individual share award, each SMS/CMS system 106 may use this information to determine rewards that are provided to the slot machine players. The rewards may be provided in the form of non-cashable, cashable or hand-paid reward credits. The operation of the personalized rewards server 114 and the SMS/CMS systems 106 at the participating properties 102 will be discussed in greater detail below.

A slot machine 104 may be configured so that for every complete pay cycle, the slot machine 104 keeps a certain percentage of the money that is wagered. This percentage is sometimes referred to as the "hold percentage." The methods described herein may have the effect of adjusting the hold percentage of the slot machines 104 at participating properties 102 based on the level of play of particular players during a defined reward event. Thus, players that spend more money during the reward event are essentially rewarded with lower hold percentages (through the issuance of additional reward credits) than other players who do not spend as much money during the reward event. Advantageously, the methods described herein allow hold percentages to be changed for individual players without the need to make adjustments to the slot machines 104 themselves.

Figure 2:
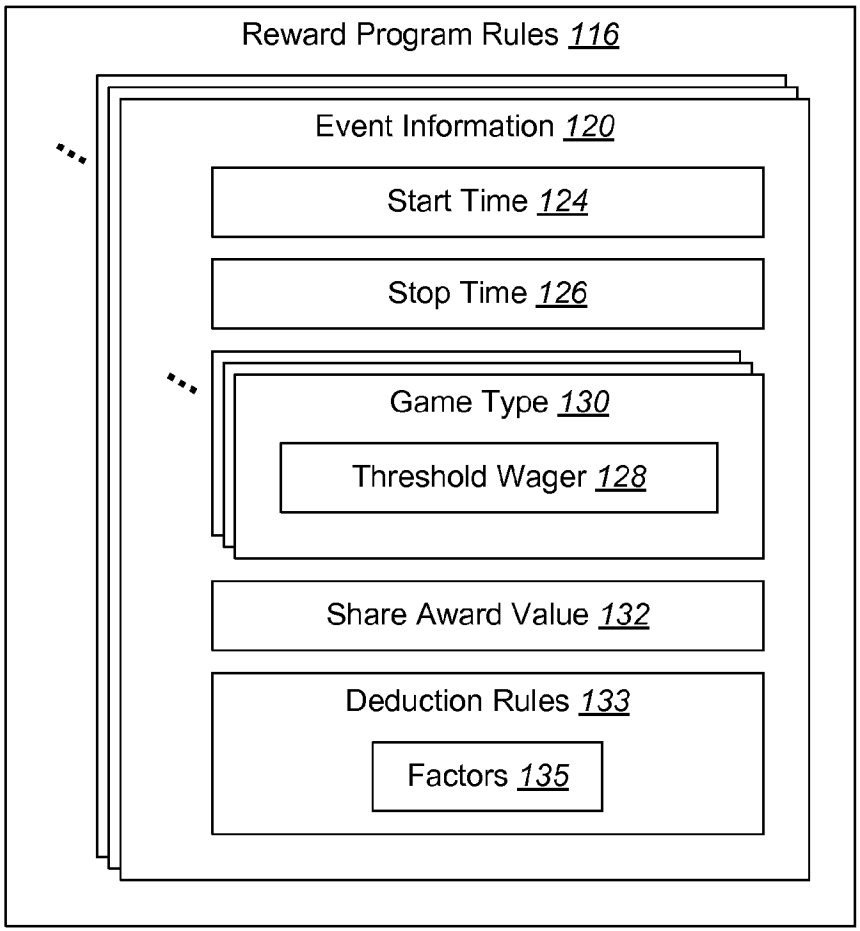
FIG. 2 illustrates exemplary reward program rules that may be defined.

As mentioned above, various reward program rules 116 may be defined, and the SMS/CMS system 106 at a particular property 102 may access these rules 116 to implement aspects of the reward programs disclosed herein. FIG. 2 illustrates exemplary reward program rules 116 that may be defined in accordance with an embodiment. As mentioned above, in accordance with an embodiment players may be allowed to participate in pre-determined reward events.

The reward program rules 116 may include information 120 about each reward event that is held. Each event may have a defined start time 124 and a defined stop time 126. The start time 124 may indicate the time when the reward event begins. The stop time 126 may indicate the time when the reward event ends. In accordance with an embodiment, each event may be defined to last one day (24 hours). For example, the start time 124 for the event may be defined as a certain time on a particular day, and the stop time 126 for the event may be defined as the same time on the following day.

Multiple properties 102 may participate in the same reward event. Where this occurs, the start time 124 and the stop time 126 of the event may be the same for the different properties 102. Alternatively, a different start time 124 and stop time 126 may be defined for different properties 102.

A threshold wager 128 may be defined for each reward event 120. When a player wagers an amount of money on the slot machines 104 that is equal to the threshold wager 128 that has been defined for the event, then the player may receive a share award. Accordingly, players that wager more money on the slot machines 104 may receive more share awards. For example, suppose that the threshold wager 128 is defined as $100. A player with a smaller budget may only make the threshold wager 128 one time (e.g., $100/$100 threshold=1 share award). However, a player with a larger budget may make the threshold wager 128 several times (e.g., $5000/$100 threshold=50 share awards), and therefore receive several share awards.

As mentioned, multiple properties 102 may participate in the same reward event. Different thresholds 128 may be defined at different properties 102. For example, property A 102*a* may define one threshold 128 (e.g., $100) to earn a share award, while property B 102*b*, property C 102*c*, and property D 102*d* may define a higher threshold 128 (e.g., $150) to earn a share award.

As shown in FIG. 2, different thresholds 128 may be defined for different game types 130 (e.g., different types of slot machines 104). For example, one type 130 of slot machine 104 may provide a share award after a $100 wager, while another type 130 of slot machine 104 may provide a share award after only a $50 wager.

Different thresholds 128 may be defined based on other factors as well. For example, different thresholds 128 may be defined based on the coin denomination that is used on the slot machine 104, the location (which may be referred to as a "zone") within the property 102 where the slot machine 104 is located, etc. Also, different thresholds 128 may be defined based on different combinations of factors.

The event rules 116 may also indicate the value 132 of an individual share award for the reward event. The share award value 132 may be used to determine the reward credits that are provided to participating slot machine players. At the end of a reward event, the personalized rewards server 114 may determine the share award value 132 for that event, and communicate the share award value 132 to the SMS/CMS systems 106 at the various properties 102 that are participating in the reward event. The SMS/CMS systems 106 may then use the share award value 132 to determine the reward credits that are provided to participating slot machine players. For example, if the individual share award value 132 is $5.20 for a particular reward event, a player who has earned ten share awards may receive $52.00 in reward credits (e.g., in the form of non-cashable, cashable or hand-paid slot system credits).

As will be described below, the share award value 132 may depend on the total amount to be distributed as part of the reward event. The share award value 132 may depend on other factors as well. For example, the share award value 132 may depend on a promotion code, a date, a property 102, etc.

The event rules 116 may facilitate the deduction of unused reward credits that have been provided to slot machine players, so that a player's reward credits do not continue to build up indefinitely. For example, the event rules 116 may include one or more deduction rules 133. The deduction rules 133 may define under what circumstances the reward credits may be deducted. The deduction rules 133 may depend on various factors 135. Some examples of such factors 135 include demographics, denomination, location, timing, etc.

Figure 3:
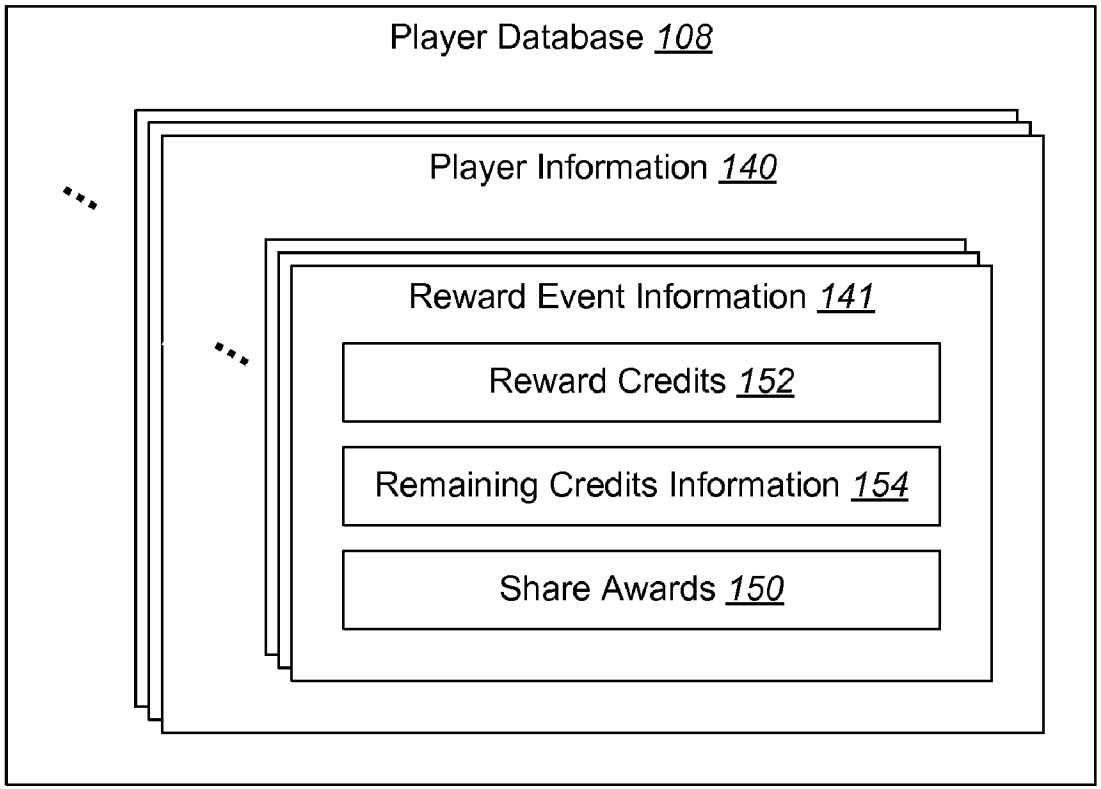
FIG. 3 illustrates information that may be stored within a player database.

FIG. 3 illustrates information that may be stored within the player database 108. The player database 108 may include information 140 about each player that has registered to participate in the reward program. The information 140 about a particular player may include information 141 about each reward event that the player has participated in. The information 141 about a particular reward event may include the share awards 150 that the player has earned during that event. The SMS/CMS systems 106 at participating properties 102 may determine the share awards 150 earned by participating players, and update the player database(s) 108 to include this information.

Each player may begin a reward event with zero share awards. At the beginning of a reward event, the SMS/CMS systems 106 at participating properties 102 may set the share awards 150 for that event to zero for each player in the player database 108.

For each reward event that a particular player has participated in, the player database 108 may also include the reward credits 152 that the player earned following the conclusion of the reward event. The reward credits 152 earned by a particular player during a particular reward event may be determined by multiplying the player's share awards 150 by the individual share award value 132 (discussed above) for the reward event.

The reward credits 152 for a particular player may include a mixture of non-cashable credits, cashable credits, and hand-paid funds. For example, the reward credits 152 up to a first threshold (0 . . . X) may be cashable credits, the reward credits 152 above the first threshold up to a second threshold (X+1 . . . Y) may be non-cashable credits, and the reward credits 152 above the second threshold (Y+1 and above) may be hand-paid funds. However, it is not necessary that reward credits 152 always include non-cashable credits, cashable credits, and hand-paid funds. For instance, in the previous example, if it were desirable to award a player only non-cashable credits and hand-paid funds, then the first threshold (X) may be set to zero.

For each reward event that a particular player has participated in, the player database 108 may also include remaining credits information 154. The remaining credits information 154 may indicate how many of the reward credits 152 that were awarded to the player as a result of the reward event have been used by the player. Alternatively, or in addition, the remaining credits information 154 may indicate how many of the reward credits 152 have not yet been used by the player. As mentioned above, a player's unused reward credits 152 may be deducted over time, and the remaining credits information 154 may be used to facilitate this feature of the reward program.

Figure 4:
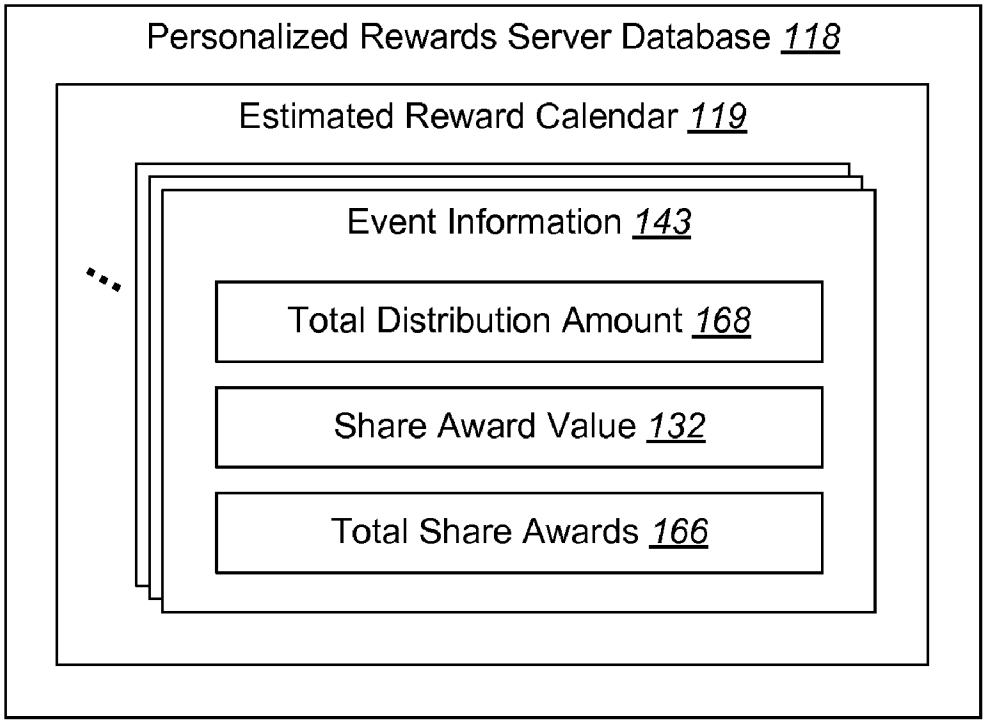
FIG. 4 illustrates information that may be stored within a personalized rewards server database.

FIG. 4 illustrates information that may be stored within the personalized rewards server database 118. The personalized reward server database 118 may include an estimated reward calendar 119. The estimated reward calendar 119 may include information 143 about each reward event that is held. For a particular reward event, the estimated reward calendar 119 may indicate the total share awards 166 that have been earned by all participating players during the reward event. Thus, the total share awards 166 may be thought of as a running tally of all of the share awards 150 that are earned by individual players. The number of share awards 150 that are earned by participating players may be reported to the personalized rewards server 114 by the SMS/CMS systems 106 at the various participating properties 102. Based on this information, the personalized rewards server 114 may update the total share awards 166 in the personalized rewards server database 118.

The information 143 about a particular reward event may also indicate the total distribution amount 168, i.e., the total amount that has been designated for distribution to slot machine players in connection with the reward event. Different distribution amounts 168 may be defined for different reward events. Alternatively, or in addition, different distribution amounts 168 may be defined for different properties 102.

The information 143 about a particular reward event may also indicate the individual share award value 132 for the reward event. The individual share award value 132 may be determined by dividing the total distribution amount 168 by the total share awards 166. The personalized rewards server 114 may determine the individual share award value 132, and then communicate the individual share award value 132 to the SMS/CMS systems 106 at the various participating properties 102.

Figure 5:
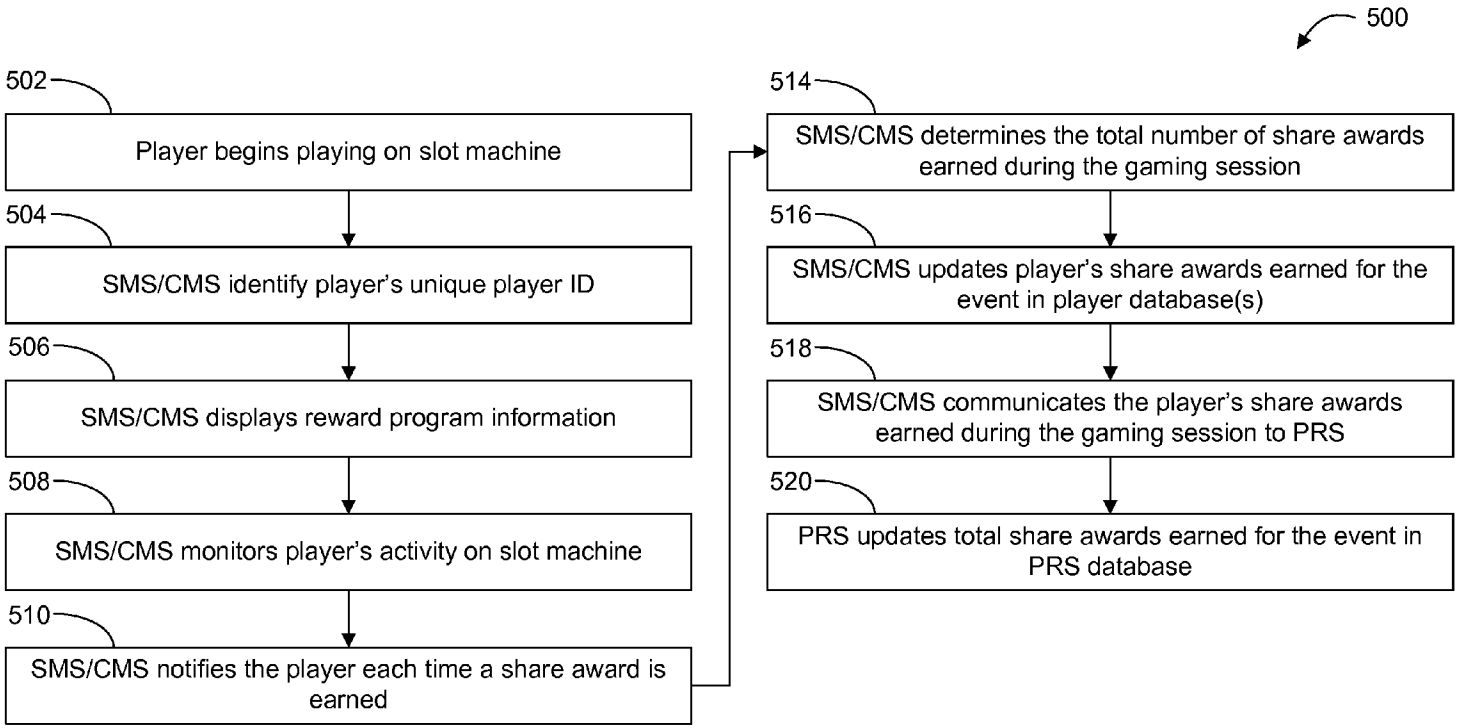
FIG. 5 illustrates how an SMS/CMS system at a particular property and a personalized rewards server may operate while a player is playing on a slot machine at the property.

FIG. 5 illustrates how the SMS/CMS system 106 at a particular property 102 and the personalized rewards server 114 may operate while a player is playing on a slot machine 104 at the property 102. The illustrated method 500 may begin when a player begins 502 playing on a slot machine 104. In response, the SMS/CMS system 106 may identify 504 a unique identifier (ID) that is associated with the player. The player may insert a player tracking card into a reader on the slot machine 104, and the SMS/CMS system 106 may identify the player by reading the player's unique player ID from the player tracking card.

When the player's unique player ID has been identified, the SMS/CMS system 106 may display 506 information about the reward program to the player. The reward program information that is displayed may include the share awards 150 that have been earned by the player to date during the reward event, how close the player is to earning another share award 150, etc. The reward program information may be displayed via a known interface, which may be part of the SMS/CMS system 106. Some examples of interfaces that may be used and that are part of the SMS/CMS system 106 include an SMS interface (e.g., a two-line text display provided as part of SMS), an iCMS interface, an Iview interface, an NT interface, etc.

As the player plays on the slot machine 104, the SMS/CMS system 106 may monitor 508 the player's activity. As discussed above, whenever the player wagers a certain amount on the slot machine 104 (e.g., the threshold wager 128 that has been defined for the event), the player may earn a share award 150. The SMS/CMS system 106 may notify 510 the player each time a share award 150 is earned. This may involve displaying a notification message on a display device that is part of (or that is somehow connected to) the slot machine 104. One type of notification message may be displayed the first time that a particular player earns a share award 150, and a different type of notification message may be displayed each subsequent time that the player earns a share award 150. Alternatively, the same type of notification message may be displayed each time that a player earns a share award 150.

When a player plays on a slot machine 104, the SMS/CMS system 106 may determine 514 the total number of share awards earned by the player during the gaming session. In this context, the term "gaming session" may refer to a continuous period of time that the player spends playing on a slot machine 104.

Under some circumstances, a player may have multiple reward cards that are each associated with the same player account. The player may use the multiple reward cards to play on multiple slot machines 104 simultaneously. The SMS/CMS system 106 may detect the simultaneous use of multiple reward cards that are each associated with the same player account, and may aggregate any share awards 150 that are provided as a result of playing on the multiple slot machines 104 simultaneously.

The SMS/CMS system 106 may update 516 the player database 108 to reflect the share awards 150 that were earned during the gaming session. In addition, the SMS/CMS system 106 may communicate 518 the share awards 150 earned during the gaming session to the personalized rewards server 114. In response to receiving this information, the personalized rewards server 114 may update 520 the total share awards 166 for the reward event in the personalized rewards server database 118.

Figure 6:
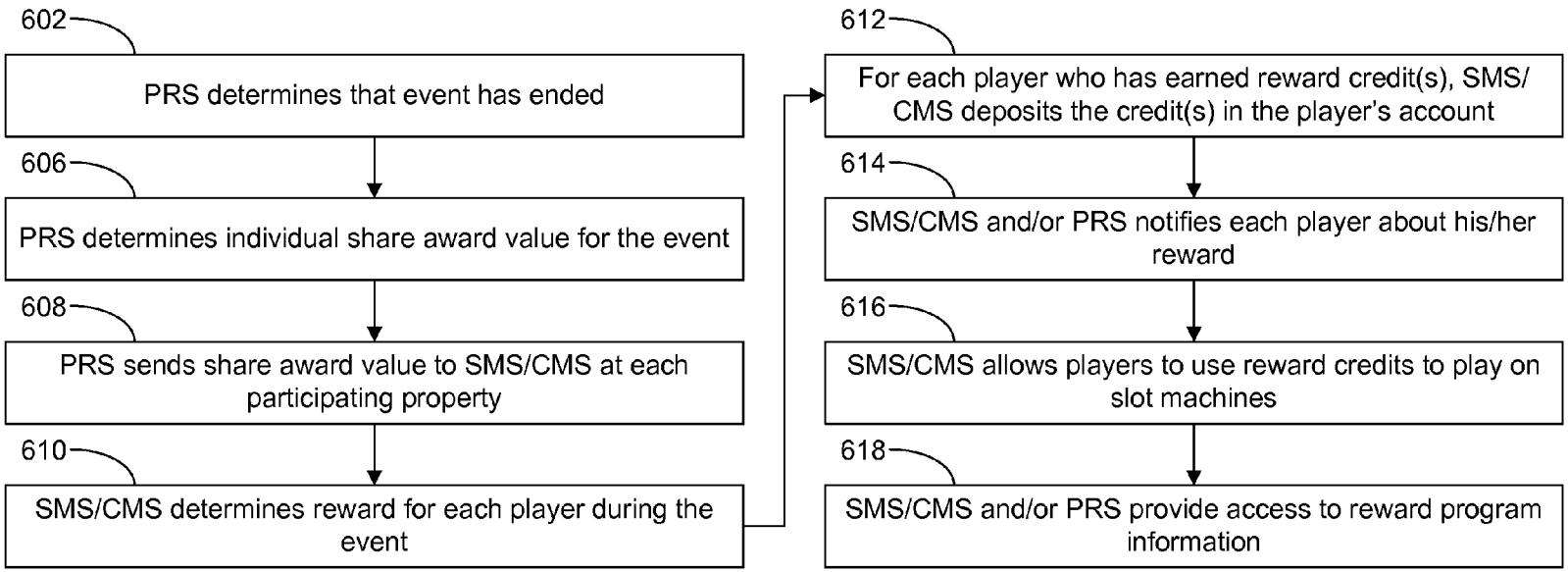
FIG. 6 illustrates how a personalized rewards server and SMS/CMS systems at participating properties may operate at the conclusion of a reward event.

FIG. 6 illustrates a method 600 showing how the personalized rewards server 114 and the SMS/CMS systems 106 at participating properties 102 may operate at the conclusion of a reward event. As shown, when the personalized rewards server 114 determines 602 that an event has ended, the personalized rewards server 114 may determine 606 the individual share award value 132 for the event. As mentioned above, the individual share award value 132 may indicate the value of each individual share award 150. The individual share award value 132 may be determined by dividing the total distribution amount 168 by the total share awards 166 that have been earned during the reward event.

When the individual share award value 132 has been determined, the personalized rewards server 114 may send 608 the individual share award value 132 to the SMS/CMS systems 106 at the various participating properties 102. In response, each SMS/CMS system 106 may determine 610 the number of reward credits 152 that may be provided to each player. The number of reward credits 152 that may be provided to a particular player may be determined by multiplying the number of share awards 150 earned by the player during the reward event by the individual share award value 132.

For each player who has earned reward credit(s) 152, the SMS/CMS system 106 may deposit 612 the reward credits 152 in the player's reward credits account. Once a player's reward credits 152 have been deposited into his/her account, the player may access his/her reward credit account and use the reward credits 152 in the account to play on slot machines 104 at participating properties 102.

The SMS/CMS systems 106 at the various participating properties 102 and/or the personalized rewards server 114 may notify 614 each player about the reward credits 152 that he/she has earned. There are a variety of ways that a player may be notified about the reward credits 152 that he/she has earned. For example, the SMS/CMS system 106 may notify players via email, text messaging, a web page, etc. The SMS/CMS systems 106 at the various participating properties 102 may then allow 616 players who have received reward credits 152 to use those reward credits 152 to play on the slot machines 104 at the participating properties 102.

The SMS/CMS systems 106 at the various participating properties 102 and/or the personalized rewards server 114 may provide 618 access to reward program information. As discussed above, such information may be accessed while playing on slot machines 104. As another example, one or more kiosks may be provided, and players may be able to access reward program information through these kiosks. As yet another example, players may be able to access reward program information via a known e-commerce interface.

Under some circumstances, the SMS/CMS system 106 and/or the personalized rewards server 114 may display information about the results of the reward event to the general public. For example, a large display device may be strategically placed in an area where it is likely to be seen by a number of potential slot machine players. This display device may show information such as the total distribution amount 168, the average number of reward credits 152 provided to players, etc.

Share awards and reward credits may be transferable between all participating properties. For example, if a player earns ten share awards at property A 102*a* and another ten share awards at property B 102*b*, then it may be said that the player has earned twenty share awards during the reward event. As another example, suppose that a player earns ten share awards at property A 102*a* and subsequently goes to property B 102*b* and begins playing on the slot machines at property B 102*b* during the same reward event. While at property B 102*b* the player may be notified about the ten share awards that he/she earned while playing at property A 102*a*.

Figure 7:
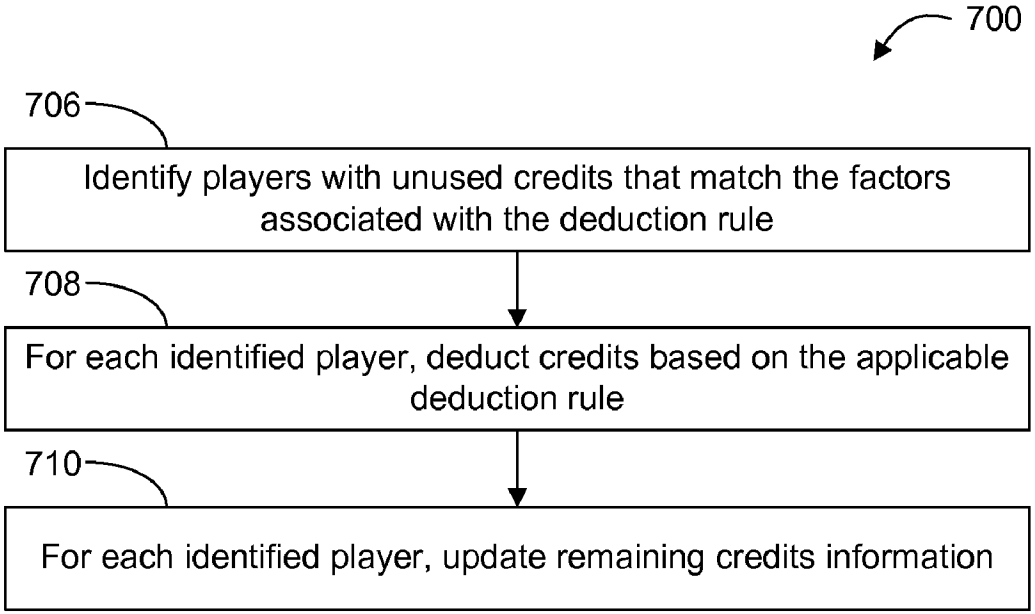
FIG. 7 illustrates how an SMS/CMS system may be configured to implement the expiration of unused reward credits over time.

As mentioned above, the event rules 116 may facilitate the deduction of unused reward credits 152 that have been provided to slot machine players, so that a player's reward credits 152 do not continue to build up indefinitely. FIG. 7 illustrates a method 700 showing how the SMS/CMS system 106 may be configured to implement the deduction of unused reward credits 152 over time.

As mentioned above, deduction rules 133 may be defined which indicate how a player's unused reward credits 152 may expire over time. The deduction rules 133 may depend on various factors 135. Some examples of such factors 135 include demographics, denomination, location, timing, etc. To take a specific example, a deduction rule 133 may be defined which indicates that a certain percentage (e.g., 10%) of the reward credits that are awarded as the result of playing in a particular type of game (e.g., a poker game) expire after a certain amount of time (e.g., 20 days). As another example, a deduction rule 133 may be defined which indicates that all reward credits expire after a certain amount of time (e.g., 30 days).

For each deduction rule 133 that has been defined, the SMS/CMS systems 106 may identify 706 one or more players that have unused reward credits 152 that match the factors 135 that are associated with the deduction rule 133. This may involve accessing the player's remaining credits information 154 that is associated with the event. For each player that is identified 706, the SMS/CMS system 106 may deduct 708 reward credits 152 from the player's reward account in accordance with the deduction rule 133. In addition, the SMS/CMS system 106 may update 710 each player's remaining credits information 154.

Figure 8:
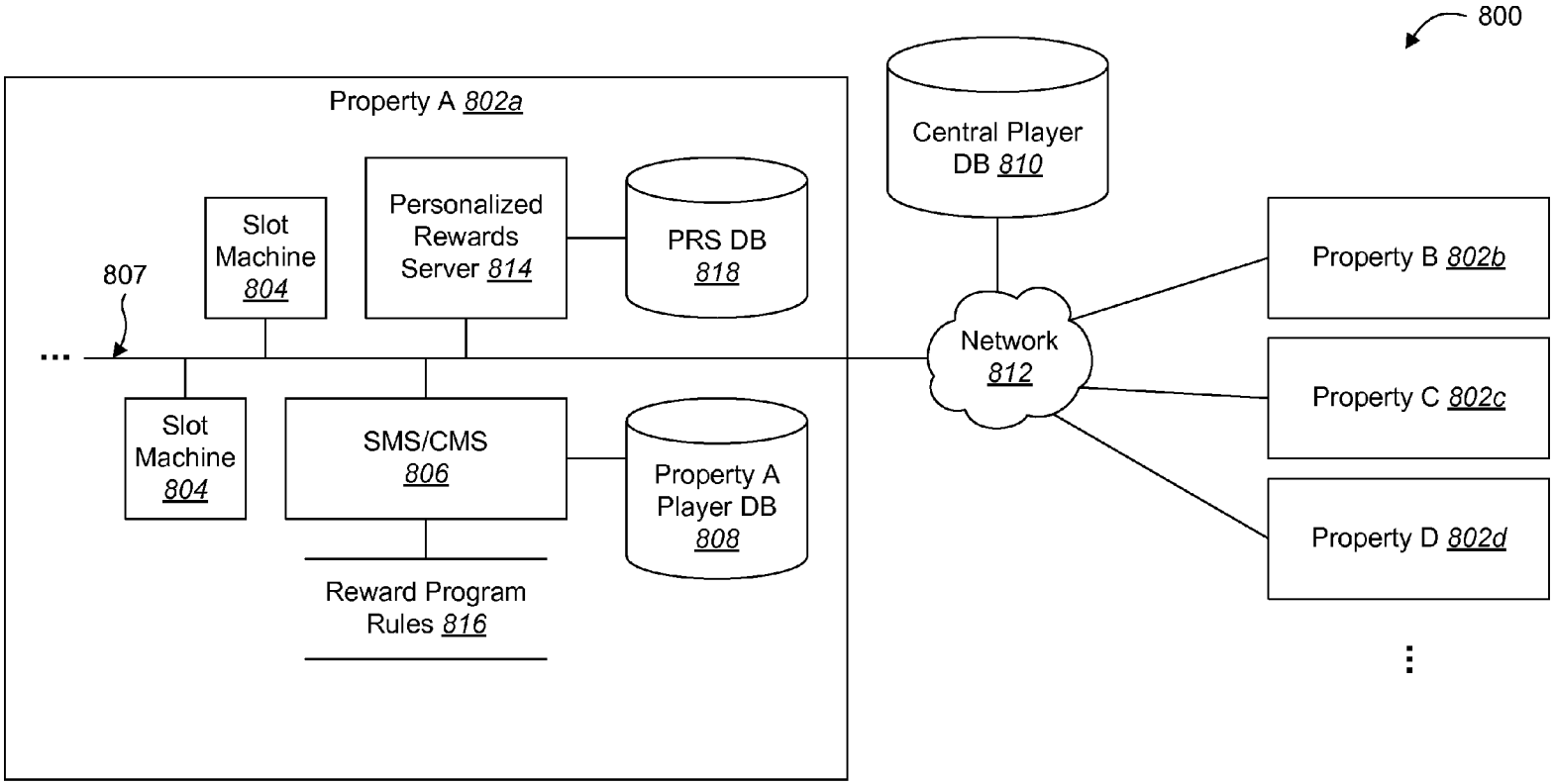
FIG. 8 illustrates another system in which embodiments may be practiced.

FIG. 8 illustrates another system 800 in which embodiments may be practiced. There are a number of similarities between the system 800 that is shown in FIG. 8 and the system 100 that is shown in FIG. 1. In particular, the system 800 shown in FIG. 8 includes a number of different properties 802, namely property A 802*a*, property B 802*b*, property C 802*c*, and property D 802*d*. A number of different slot machines 804 are shown within property A 802*a*. An SMS/CMS system 806 is provided for property A 802*a*. The slot machines 804 within property A 802*a* may be in electronic communication with the SMS/CMS system 806 via a local area network (LAN) 807. The SMS/CMS systems 806 may store information about players' activity on the slot machines 804 in one or more player databases 808. Property B 802*b*, property C 802*c*, and property D 802*d* may be configured similarly to property A 802*a*. The computer systems within property A 802*a*, property B 802*b*, property C 802*c*, and property D 802*d* may all be connected to a network 812, such as a wide area network. A central player database 810 may also be connected to the network 812. A personalized rewards server 814 may be used in connection with the SMS/CMS systems 806 to implement reward programs that provide personalized rewards to slot machine players. Various reward program rules 816 may be defined, and the SMS/CMS systems 806 may access these rules 816 to implement these reward programs.

In the system 100 that is shown in FIG. 1, one personalized rewards server 114 and one personalized rewards server database 118 are provided for multiple properties 102. In contrast, in the system 800 that is shown in FIG. 8, each property 802 includes its own personalized rewards server 814 and personalized rewards server database 818. The personalized rewards server 814 and personalized rewards server database 818 for property A 802*a* are shown in FIG. 8. Although not explicitly shown in FIG. 8, property B 802*b*, property C 802*c*, and property D 802*d* may each include a personalized rewards server 814 and a personalized rewards server database 818. The personalized rewards server 814 and the personalized rewards server database 818 at a particular property 802 may function as described above.

Figure 9:
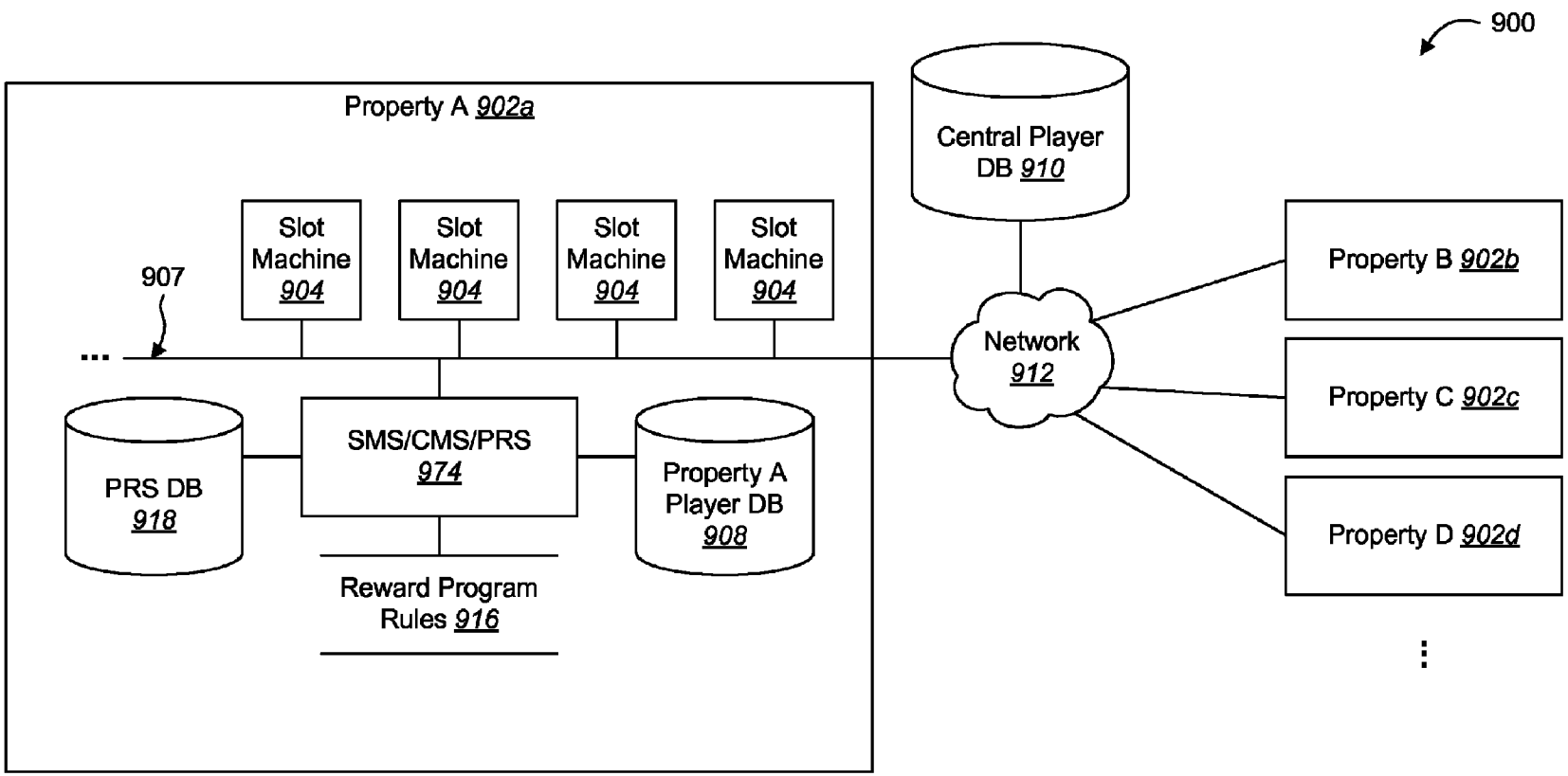
FIG. 9 illustrates another system in which embodiments may be practiced.

FIG. 9 illustrates another system 900 in which embodiments may be practiced. There are a number of similarities between the system 900 that is shown in FIG. 9 and the system 100 that is shown in FIG. 1. In particular, the system 900 that is shown in FIG. 9 includes a number of different properties 902, namely property A 902*a*, property B 902*b*, property C 902*c*, and property D 902*d*. A number of different slot machines 904 are shown within property A 902*a*. The slot machines 904 within property A 902*a* may each be connected to a local area network (LAN) 907. Property B 902*b*, property C 902*c*, and property D 902*d* may be configured similarly to property A 902*a*. The computer systems within property A 902*a*, property B 902*b*, property C 902*c*, and property D 902*d* may all be connected to a network 912, such as a wide area network. A central player database 910 may also be connected to the network 912.

In the systems 100, 800 shown in FIGS. 1 and 8, the SMS/CMS system 106, 806 and the personalized rewards server 114, 814 are shown as separate components. In contrast, in the system 900 that is shown in FIG. 9, the SMS/CMS and the personalized rewards server are shown as a single component, which will be referred to as an SMS/CMS/PRS component 974. The SMS/CMS/PRS component 974 may perform the functionality of the SMS/CMS systems 106, 806 and the personalized rewards servers 114, 814 discussed above. For example, the SMS/CMS/PRS component 974 may monitor player activity on the slot machines 904, and provide share awards to players based on their level of play on the slot machines 904. At the end of a defined reward event, the SMS/CMS/PRS component 974 may determine the value of an individual share award, and may use this information to determine the number of reward credits that may be provided to participating players. The SMS/CMS/PRS component 974 may utilize a player database 908, reward program rules 916, and a personalized rewards server database 918 in the manner described above.

Figure 10:
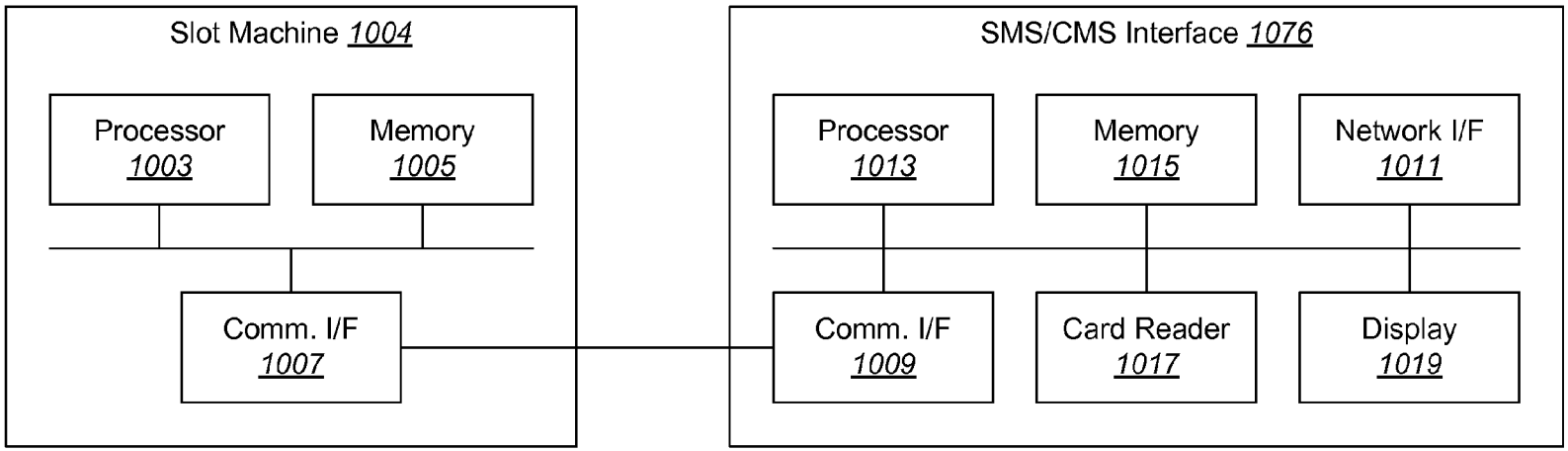
FIG. 10 illustrates an example of a slot machine configuration.

FIG. 10 illustrates an example of a slot machine configuration that may be utilized. A slot machine 1004 is shown with a processor 1003 and memory 1005. The processor 1003 may control the operation of the slot machine 1004 and may be embodied as a microprocessor, a microcontroller, a digital signal processor (DSP) or other device known in the art. The processor 1003 typically performs logical and arithmetic operations based on program instructions stored within the memory 1005. The program instructions within the memory 1005 may be executed by the processor 1003 to implement the different types of games that may be played on the slot machine 1004.

The slot machine 1004 is also shown with a communication interface 1007. The communication interface 1007 may be used to communicate with an SMS/CMS interface component 1076. The SMS/CMS interface component 1076 may include a communication interface 1009 for communicating with the slot machine 1004. The SMS/CMS interface component 1076 is also shown with a network interface 1011, which may be used to communicate with an SMS/CMS system (e.g., the SMS/CMS system 106 shown in FIG. 1) via a network.

The SMS/CMS interface component 1076 is also shown with a processor 1013 and memory 1015. The processor 1013 may perform logical and arithmetic operations based on program instructions stored within the memory 1015. The program instructions within the memory 1015 may be executed by the processor 1013 to implement various features of the reward programs described herein, such as identifying the current player on the slot machine 1004, determining the number of share awards that the player has received during a gaming session, etc. Alternatively, these functions may be performed by an SMS/CMS system, and the SMS/CMS interface component 1076 may simply provide signals to the SMS/CMS system that are subsequently interpreted by the SMS/CMS system. Advantageously, it is not necessary to make any changes to the slot machine 1004 itself to implement the reward programs described herein.

The SMS/CMS interface component 1076 may also include a card reader 1017. When a player begins playing on the slot machine 1004, the player may insert a player tracking card into the card reader 1017, and the card reader 1017 may extract the player's unique player ID from the player tracking card. This may have the effect of identifying the player.

The SMS/CMS interface component 1076 may also include a display 1019. The display 1019 may be used to communicate to the current player of the slot machine 1004 certain information, such as the share awards that the player has earned, the amount of money that the player may wager in order to receive another share award, etc.

Information and signals may be represented using any of a variety of different technologies and techniques. For example, data, instructions, commands, information, signals and the like that may be referenced throughout the above description may be represented by voltages, currents, electromagnetic waves, magnetic fields or particles, optical fields or particles or any combination thereof.

The various illustrative logical blocks, modules, circuits and algorithm steps described in connection with the embodiments disclosed herein may be implemented as electronic hardware, computer software or combinations of both. To clearly illustrate this interchangeability of hardware and software, various illustrative components, blocks, modules, circuits and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as limiting the scope of the claims.

The various illustrative logical blocks, modules and circuits described in connection with the embodiments disclosed herein may be implemented or performed with a general purpose processor, a digital signal processor (DSP), an application specific integrated circuit (ASIC), a field programmable gate array signal (FPGA) or other programmable logic device, discrete gate or transistor logic, discrete hardware components or any combination thereof designed to perform the functions described herein. A general purpose processor may be a microprocessor, but in the alternative, the processor may be any conventional processor, controller, microcontroller or state machine. A processor may also be implemented as a combination of computing devices, e.g., a combination of a DSP and a microprocessor, a plurality of microprocessors, one or more microprocessors in conjunction with a DSP core or any other such configuration.

The steps of a method or algorithm described in connection with the embodiments disclosed herein may be embodied directly in hardware, in a software module executed by a processor or in a combination of the two. A software module may reside in any form of storage medium that is known in the art. Some examples of storage media that may be used include RAM memory, flash memory, ROM memory, EPROM memory, EEPROM memory, registers, a hard disk, a removable disk, a CD-ROM and so forth. A software module may comprise a single instruction, or many instructions, and may be distributed over several different code segments, among different programs and across multiple storage media. An exemplary storage medium may be coupled to a processor such that the processor can read information from, and write information to, the storage medium. In the alternative, the storage medium may be integral to the processor.

The methods disclosed herein comprise one or more steps or actions for achieving the described method. The method steps and/or actions may be interchanged with one another without departing from the scope of the claims. In other words, unless a specific order of steps or actions is required for proper operation of the embodiment that is being described, the order and/or use of specific steps and/or actions may be modified without departing from the scope of the claims.

While specific embodiments have been illustrated and described, it is to be understood that the claims are not limited to the precise configuration and components illustrated above. Various modifications, changes and variations may be made in the arrangement, operation and details of the embodiments described above without departing from the scope of the claims.

What is claimed is:

1. A method for providing a personalized rewards program for slot machine players, comprising:

monitoring, by a computing device, activity of slot machine players on one or more slot machines during a reward event;

providing, by the computing device, one share award to a slot machine player each time the slot machine player wagers a threshold amount on the one or more slot machines during the reward event wherein multiple share awards are earned per player;

determining, by the computing device, reward credits to be provided to the slot machine players, wherein the reward credits that are provided to a slot machine player are determined by multiplying the share awards that were provided to the slot machine player during the reward event by an individual share award value for the reward event, and wherein the individual share award value for the reward event is determined by dividing a total amount of money to be distributed to the slot machine players as part of the reward event by a total share awards earned by the slot machine players during the reward event; and distributing, by the computing device, the reward credits to the slot machine players.

2. The method of claim 1, further comprising displaying a notification message on a display screen of a slot machine in response to a current player of the slot machine qualifying for an initial share award.

3. The method of claim 1, further comprising displaying a notification message on a display screen of a slot machine each time that a current player of the slot machine qualifies for an additional share award.

4. The method of claim 1, wherein the threshold amount for a slot machine depends on at least one of: a property where the slot machine is located, a zone in the property in which the slot machine is located, a coin denomination that is used by the slot machine, a game type that is being played on the slot machine, and combinations thereof.

5. The method of claim 1, further comprising providing an estimated reward calendar that indicates a total amount of money to be distributed to the slot machine players as part of the reward event.

6. The method of claim 1, wherein the individual share award value further depends on at least one of: a promotion code, a date, and a property.

7. The method of claim 1, further comprising:

detecting when multiple reward cards associated with a same player account are used to play on multiple slot machines simultaneously; and aggregating any share awards that are provided as a result of playing on the multiple slot machines simultaneously.

8. The method of claim 1, further comprising, when a subsequent reward event begins, setting the slot machine players' share awards for the subsequent reward event to zero.

9. The method of claim 1, further comprising notifying the slot machine players about the reward credits.

10. The method of claim 9, wherein the slot machine players are notified about the reward credits via e-mail.

11. The method of claim 1, wherein the reward credits that are provided to a qualifying player comprise:

non-cashable credits up to a first reward threshold;

cashable credits between the first reward threshold and a second reward threshold, wherein the second reward threshold is greater than the first reward threshold; and hand-paid funds beyond the second reward threshold.

12. The method of claim 1, further comprising allowing the slot machine players who have received the reward credits to use the reward credits to play on the one or more slot machines.

13. The method of claim 1, further comprising deducting at least some of the reward credits from the slot machine players' accounts based on one or more defined adjustment rules.

14. The method of claim 1, further comprising displaying reward program information on a display screen of a slot machine.

15. The method of claim 1, further comprising providing access to reward program information via one or more kiosks.

16. The method of claim 1, further comprising providing access to reward program information via an e-commerce interface.

17. A method for providing a personalized rewards program for slot machine players, comprising:

monitoring, by a computing device, activity of slot machine players on slot machines at one or more participating properties during a reward event;

providing, by the computing device, one share award to a slot machine player each time the slot machine player wagers a threshold amount on the one or more slot machines during the reward event wherein multiple share awards are earned per player.

determining, by the computing device, reward credits to be provided to the slot machine players, wherein the reward credits that are provided to a slot machine player are determined by multiplying the share awards that were provided to the slot machine player during the reward event by an individual share award value for the reward event, and wherein the individual share award value for the reward event is determined by dividing a total amount of money to be distributed to the slot machine players as part of the reward event by a total share awards earned by the slot machine players during the reward event; and adjusting, by the computing device, hold percentages of the slot machines for the slot machine players based on the slot machine players' level of play during the reward event by distributing the reward credits to the slot machine players, wherein the hold percentages are adjusted without making adjustments to the slot machines themselves.

* * * * *